US007284662B2

(12) United States Patent
DeBusk et al.

(10) Patent No.: US 7,284,662 B2
(45) Date of Patent: Oct. 23, 2007

(54) RETAIL DISPENSING AND DISPLAY CARTON

(75) Inventors: Patrick James DeBusk, Canton, GA (US); Chuck Tarlton, Atlanta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 521 days.

(21) Appl. No.: 10/838,589

(22) Filed: May 4, 2004

(65) Prior Publication Data

US 2005/0247595 A1 Nov. 10, 2005

(51) Int. Cl.
*B65D 79/00* (2006.01)

(52) U.S. Cl. ..... 206/745; 206/774

(58) Field of Classification Search ..... 206/192, 206/774, 745, 746, 736; 229/122, 122.1, 229/235

See application file for complete search history.

(56) References Cited

U.S. PATENT DOCUMENTS 2,751,964 A * 6/1956 Guyer ..... 156/205
2,875,938 A 3/1959 Bramhill
3,056,665 A 10/1962 Linda et al.
3,620,439 A * 11/1971 Morse et al. ..... 229/208
3,884,348 A * 5/1975 Ross ..... 206/746
4,398,636 A 8/1983 Baxter
5,690,213 A * 11/1997 Matsumura ..... 206/45.21
6,062,424 A 5/2000 Simile-Gravina et al.
6,135,289 A * 10/2000 Miller ..... 206/774

FOREIGN PATENT DOCUMENTS

| | | |
|---|---|---|
| CA | 2 441 747 | 3/2004 |
| DE | 1 049 299 | 1/1959 |
| DE | 75 07 937 | 7/1975 |
| DE | 93 17 034.3 | 4/1994 |
| GB | 2 278 341 A | 11/1994 |
| JP | 03275438 A * | 12/1991 |

* cited by examiner

*Primary Examiner*—David T. Fidei
(74) *Attorney, Agent, or Firm*—Womble Carlyle Sandridge & Rice, PLLC

(57) ABSTRACT

An enclosed carton is provided that allows a product to be shipped, displayed, and dispensed all from the same carton. An enclosed carton is filled with product, sealed, and shipped to its destination. The carton can be "cracked" in half along a tear line and the back half is hinged downward to set the carton upright on its sealed ends, with one-half facing outward and the other half facing inward. A detachable dispenser, large enough to dispense product, is removed from the lower front half of the carton. Once the front half is emptied of product, it can either be detached from the back half at the tear line or remain as void filler on the shelf. The carton then is rotated 180 degrees at its base and a detachable dispenser, large enough to dispense product, is removed from the lower end of the back half of the carton.

39 Claims, 6 Drawing Sheets

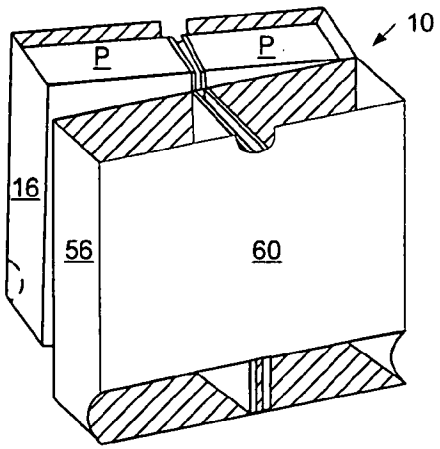
FIG. 6
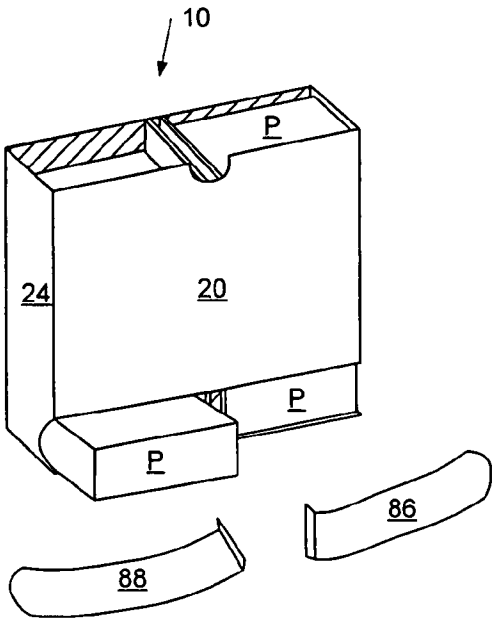
FIG. 7
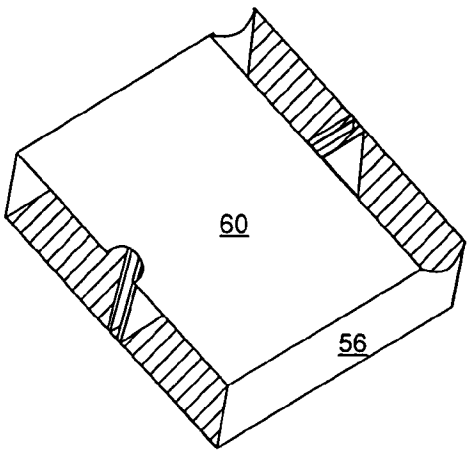

RETAIL DISPENSING AND DISPLAY CARTON

FIELD OF THE INVENTION

The present invention relates to a paperboard carton for housing containers, which carton has unique shipping, displaying, and dispensing features. The carton allows the containers to be shipped, displayed, and dispensed in a retail environment, all from the same carton.

BACKGROUND

Retail products generally are packaged in containers, e.g. boxes, can, cartons, etc., which are then placed on a retailer's shelves for display and sale. In order to reach a retailer's shelf, a manufactured product are packaged for shipping, shipped, unpackaged, arranged, and maintained on a shelf. Once products are packaged during manufacture in the retail package, these packaged products are then loaded individually in larger shipping containers and shipped to retailers. The retailers then unpack the packaged products from the shipping containers and place the individually packaged products on their shelves. After consumer's take the first few packaged products from the shelf, the retailer must move the remaining packaged products on the shelf to present an organized and evenly distributed display. Additionally, the retailer must timely rotate the packaged products from back to front to ensure that packaged products do not exceed their expiration dates. This unpackaging, fronting, and rotation creates waste from the shipping containers and is expensive in terms of time and labor. The known prior art has failed to provide a single carton that can be used to ship, display, and dispense individually packaged products from the same carton.

SUMMARY

Briefly described, the present carton is separable in half, with a dispenser in the lower front section of the each half of the carton. This carton is generally rectangular and has a bottom, a top, two sides, and two ends. The carton is foldably constructed from a blank having panels and flaps. Packaged products are removed from the carton through dispensers on the lower panels of each half. The carton preferably is made of paperboard, although other materials such as cardboard and non-fibrous, relatively stiff, foldable material, such as plastic, composite or metal, can be used.

Product can be loaded in either or both ends of the present carton, and shipped to a retailer. The retailer can open the carton by "cracking" or breaking the carton in half through a series of cuts that form a tear line, preferably located half the distance from the sealed ends of the carton. The carton cracking can be assisted by a finger hole along the series of cuts.

The carton then can be "oriented" upright, with the sealed ends of the carton resting on a surface, such as a retailer's shelf, and with the front half of the carton facing outwardly. The retailer then removes the lower front dispensing section of the carton to expose the product and to create an opening large enough for the product to be removed. When the front half of the carton has been emptied of product, the retailer turns the carton around so that the back half of the carton faces outwardly. The lower dispensing section of the back half of the carton is removed, and the product in the back half of the carton is exposed through an opening large enough to allow removal of the product. Further, after the front half is emptied of product, the front half either can be detached from the back half of the carton and discarded, or can remain attached and the entire carton can be reversed so that the back half of the carton faces outwardly. If the front half of the carton remains attached, the front half can act as void filler on the retail shelf, while dispensing out the back half. The entire carton is discarded when emptied.

A carton that performs the functions as detailed herein is formed from a blank that can include a center divider to provide separation of the product for easier dispensing and/or to provide additional structural support. The blank and carton shown in the embodiment of FIG. 1 includes two columns, but could include any number of columns. The separation of the product by a center divider allows for easier dispensing by enabling a person's fingers to grasp the product stacked therein. Because the openings at the lower front section of the carton are located in lower ends of the carton, the product can be removed in such a way that all product above the one removed will drop down via gravity towards the bottom of the carton. This gravity dispensing will allow for removal of the next product and so on until the entire product has been completely removed from each half of the carton.

The carton blank may also be formed with additional strips applied to the carton in areas that require additional strength for integrity in stacking, shipping, or displaying. Such additional strips provided for strength are described in U.S. patent application Ser. Nos. 09/971,469 and 09/559,704, which are currently pending and commonly owned by the present assignee.

This carton has dispensers that are formed in each end of the carton by tearing and removing end portions of the front panel and back panel in succession. Typically, the lower section of the half of the carton that faces outwardly is removed for dispensing, e.g. on a retailer's shelf. Each lower section dispenser can further be divided in half at a divisor line to allow dispensing of product from each column of a carton half at a time. The other half of the lower section dispenser subsequently can be removed for dispensing of the other column of the carton half. These dispenser halves can include additional tear lines, spaced from the divisor line, that are capable of being punched into the carton with a finger or other object to commence opening of the lower dispensing section. Each lower section dispenser may have a tear or score line in the side panel, such as a semi-circular score line, attached to the lower section dispenser score line in the front or back panel to provide a gap that allows entry of a person's finger or other object to more easily grasp the product for dispensing.

An additional benefit of the present carton design is that the top of each carton half remains open during dispensing. A customer can dispense a product from a carton half, subsequently decide for whatever reason that they do not want the dispensed product, and return the undesired product to the carton by placing it into the top opening formed by the cracking of the carton. The product returned to the carton half eventually will gravity feed to the lower section dispenser for later dispensing. This open top will also provide easy access for a retailer to restock product into the carton half as desired.

Alternative embodiments of the present carton include single column dispensers without divider panels, and cartons that can accommodate different sized products. The carton also can be formed with side-by-side dispensers instead of front and back halves. In this embodiment, the dispensers can both be opened at the same time and can be separated from each other to discard an empty side.

These and other objects, features, and advantages of the present invention will become more apparent upon reading the following specification in conjunction with the accompanying drawing figures.

BRIEF DESCRIPTION OF THE DRAWINGS

FIG. 6 is a perspective view of the carton with the back dispenser removed from the front dispenser.

FIG. 7 is a perspective view of the carton with the back dispenser in a dispensing configuration.

DETAILED DESCRIPTION OF THE INVENTION

To facilitate understanding and explanation of the blank 10 of the present invention, the elements and numerals described herein will utilize the terms "upper," "lower," "top," "bottom," "front," and "back" to distinguish portions of the halves of the carton and of the blank 10. These conventions are included merely for ease of explanation and understanding of the present description, however, and should not be limiting in any manner. The descriptions of the panels as "upper," "lower," etc., also can be referred to as "first," "second," etc. For example, in FIG. 1, top panel 20 is indicated as being in the upper portion of blank 10 and top panel 60 is indicated as being in the lower portion of the blank 10. One of ordinary skill will understand that top panel 60 could be the upper portion of the blank 10, with top panel 20 being the lower portion, if the carton's orientation is reversed. Further, when the carton is formed, top panel 20 forms a wall of the front half of the carton and top panel 60 forms a wall of the back half of the carton in the description herein. This orientation can easily be reversed in practice, and use with the top panel 60 acting as part of the front half and top panel 20 acting as part of the back half of the carton.

Figure 1:
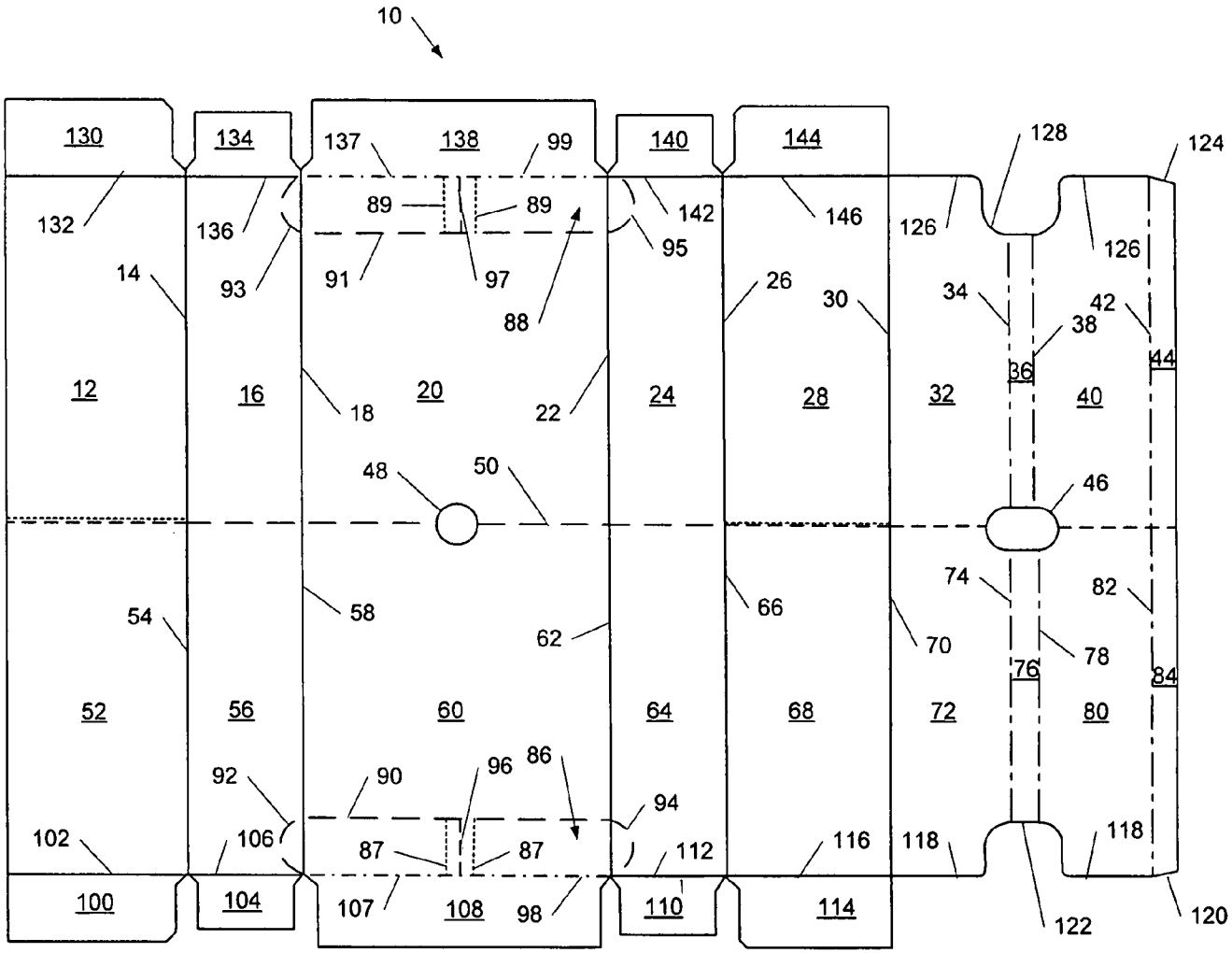
FIG. 1 is a plan view of a blank from which a carton according to the invention is formed.

The present carton is intended primarily for use with containers of product P that are individually dispensed, such as those containing foodstuffs. As shown in FIG. 1, a blank 10, which forms a carton, is formed from a foldable sheet material, such as paperboard. At the upper end, the blank 10 has a bottom flap 12, which is connected by fold line 14 to side panel 16, which is in turn connected by fold line 18 to top panel 20. Top panel 20 is connected by fold line 22 to side panel 24, which in turn is connected by fold line 26 to bottom flap 28. Bottom flap 28 is connected by fold line 30 to divider panel 32, which in turn is connected by fold line 34 to adhesive panel 36. Adhesive panel 36 is connected by fold line 38 to divider panel 40, which in turn is connected by fold line 42 to adhesive panel 44. An access port 46 is cut or otherwise formed at the intersection of divider panels 32, 40, 72, and 80 along a tear line 50. A finger hole 48 is formed in top panels 20 and 60 and disposed along tear line 50. The finger hole 48 will enable receipt of a person's finger or other object to begin tearing of tear line 50 to crack open and convert the carton from a shipping/storage configuration to a display and/or dispensing configuration. The access port 46 provides a space in the carton interior for access to the finger hole 48 to crack open the carton to separate the front half of the carton from the back half. Although the access port 46 and finger hole 48 are shown ecliptic and circular, respectively, they could be formed in any other desired configuration that permits disengagement of tear line 50 to separate the carton in two halves. Alternatively, the finger hole 48 could be covered with a flap (not shown) that could be punctured or otherwise detached to provide access to the finger hole 48 to disengage tear line 50.

At the lower end of the blank 10, a bottom flap 52 is connected by fold line 54 to side panel 56, which in turn is connected by fold line 58 to top panel 60. Top panel 60 is connected by fold line 62 to side panel 64, which in turn is connected by fold line 66 to bottom flap 68. Bottom flap 68 is connected by fold line 70 to divider panel 72, which in turn is connected by fold line 74 to adhesive panel 76. Adhesive panel 76 is connected by fold line 78 to divider panel 80, which in turn is connected by fold line 82 to adhesive panel 84. In order to form a carton that does not bow in the middle, the divider panels 32, 40, 72, and 80 are generally formed slightly smaller in width than side panels 16, 24, 56, and 60.

At the lower end of the carton blank 10, bottom end flap 100 is connected to bottom flap 52 by a fold line 102. Side end flap 104 is connected to side panel 56 by a fold line 106. Top end flap 108 is connected to top panel 60 via tear line 98 and/or fold line 107. Side end flap 110 is connected to side panel 64 by a fold line 112. Bottom end flap 114 is connected to bottom flap 68 by a fold line 116. The divider panel end 118 is provided with a divider panel end cutout 122, which will provide a space for a person's fingers to grasp the product to facilitate removal of the product once the carton is formed and the dispenser 86 is removed. The adhesive panel 84 has an adhesive panel end 120, which is angled slightly inward, to facilitate folding of the carton.

At the upper end of the carton blank 10, adhesive panel 44 has an angled adhesive panel end 124. Adhesive panels ends 120 and 124 allow for any slight misalignment during manufacture of the carton from blank 10 and keep the end flap away from the score line, which could create folding/construction difficulties. Divider panels 32, 40 include a divider panel end 126 and a divider panel end cutout 128, which facilitate removal of the product through dispenser 88 once the carton is formed. The divider panels shown in FIG. 1 provide adequate space for the insertion of a user's finger or other object to grab the dispensers 86 and 88 for removal from the formed carton by tearing the dispenser or dispenser flaps 86 and 88 along tear lines 91, 99.

At the upper end, bottom end flap 144 is connected to bottom flap 28 by fold line 146. Side end flap 140 is connected to side panel 24 by fold line 142. Top end flap 138 is connected to top panel 20 at tear line 99 and/or fold line 137. Side end flap 134 is connected to side panel 16 at fold line 136. Bottom end flap 130 is connected to bottom flap 12 at fold line 132.

FIG. 1 shows tear line 50 with cuts, nicks, tears, and creases alone and in different combinations along the panels of the blank 10. The particular orientations and combinations shown in FIG. 1 are exemplary and should not be limiting in any manner. However, some guidelines are typically followed for tear line formation. For example, between the finger hole 48 and the intersection with each side panel, tear line 50 is comprised of a combination of cuts and nicks that facilitate separation of the halves of the carton using finger hole 48. Through the bottom flaps, the tear line 50 comprises a combination of cuts and creases that create a type of "hinge," which will generally not allow as easy separation of the halves from one another as the tear line 50 that proceeds through the top and side panels. Through the divider panels 32, 40, 72, and 80, the tear line 50 includes a combination of cuts and nicks, which are generally easier to disengage than the cuts and creases through the bottom flaps to allow the divider panels to more easily separate during initial carton breaking. The dispensers 86 and 88 comprise various combinations of cuts and nicks and generally will be formed with easy to separate tear lines at 90-99.

Dispensers 86 and 88 are formed in top panels 20 and 60 and side panels 16, 24, 56, 64 at the end portions of each panel adjacent the end flaps and opposite the tear line 50. In forming dispensers 86 and 88, tear lines 90 and 91 are spaced from their respective end flaps a distance that will allow product to be removed from the carton once formed. Tear lines 92, 93, 94, 95 are formed in respective side panels 16, 24, 56, 64 and enable entire removal of the dispensers 86 and 88 from the carton. Tear lines 92, 93, 94, and 95 are shown arcuate, but could be any other configuration, such as angled or rectangular, that allow product access to the dispenser. Tear lines 98 and 99 are formed generally at respective intersecting fold lines 137 and 107 between the end flaps and the top panels 20 and 60, but could be spaced a distance from the fold line 137 and 107 depending on the product packaged in the carton. Bisecting tear lines 96 and 97 are generally provided at approximately at the center of the top panels 20 and 60 to facilitate removal of the dispenser 86 or 88 by permitting insertion of a finger or other object into the carton in the gap formed by divider panel separation. Perforations 87 and 89 are formed parallel to bisecting tear lines 96 and 97 that form flaps available to be grasped by a user to further assist removal of dispensers 86 and 88. These flaps, formed by 87, 89, 96, and 97, can either be pushed into, or pulled outward from, the carton to facilitate removal of dispensers 86 and 88. These flaps are generally received by the space created by divider panel end cutouts 112 and 128, which allow space for insertion of a finger or other object. Tear lines 96 and 97 also permit removal of only one side of the dispenser 86 or 88 at a time as desired during dispensing. Generally, the dispensers 86 or 88 will be entirely removed in succession to provide an opening to remove the product from the carton.

Figure 8:
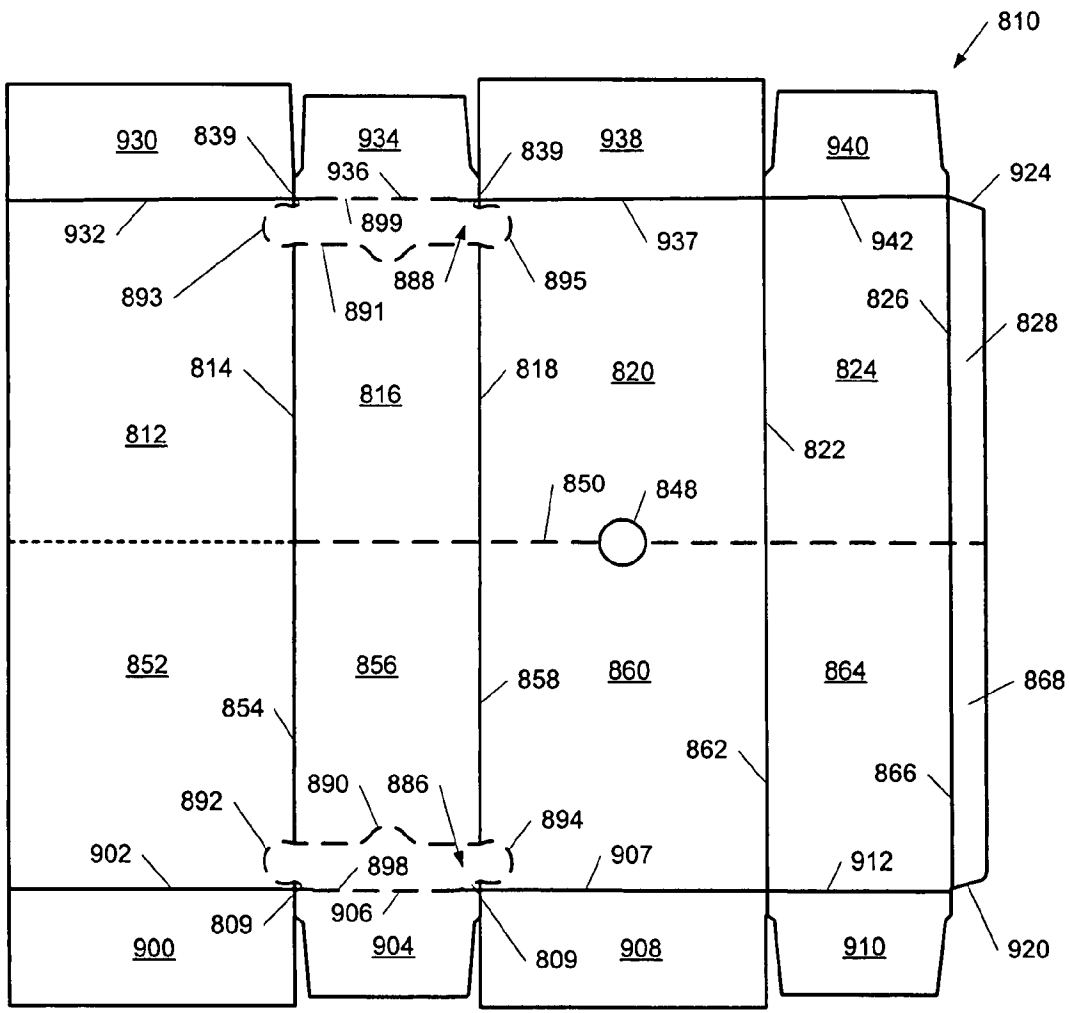
FIG. 8 shows an alternative embodiment of a side-by-side blank from which a carton can be formed.
Figure 9B:
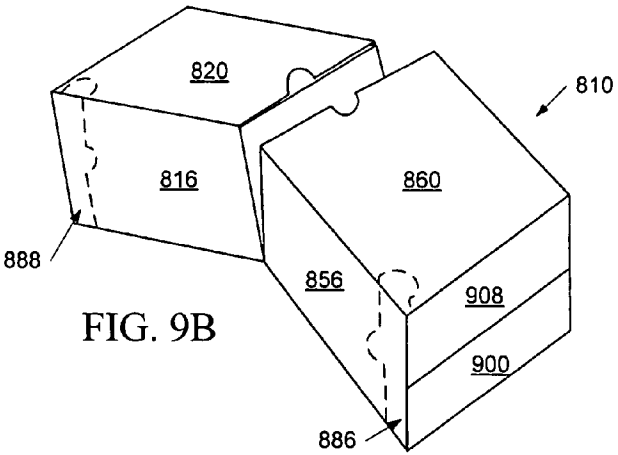
FIGS. 9A-9D show the side-by-side blank of FIG. 8 formed into a carton, cracked open, set upright, and dispensing product.
Figure 9D:
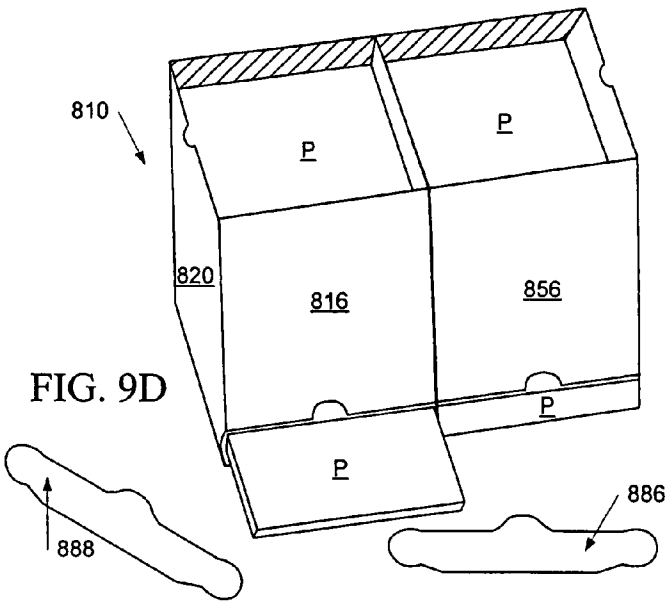
Figure 9A:
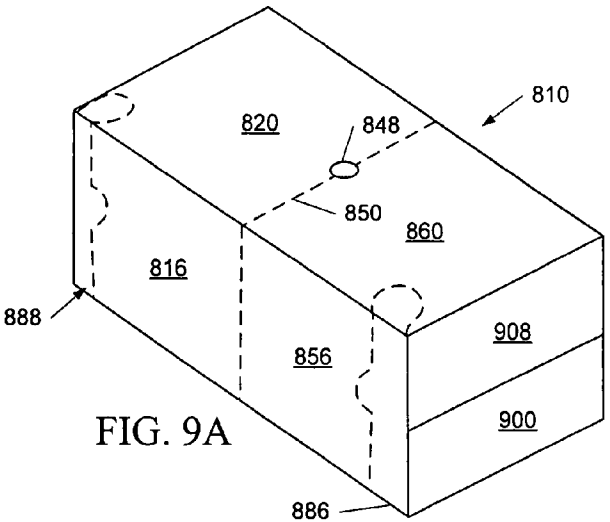
Figure 9C:
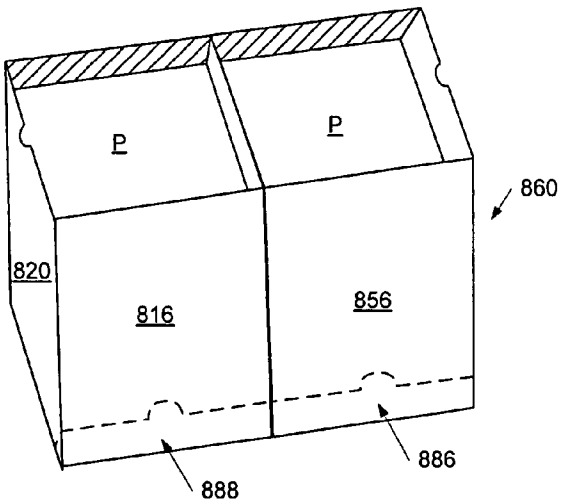

The carton blanks can be formed with any part of, or the entirety of, the dispenser tear lines spaced from the end flap fold lines. Additionally, any tear line orientation is contemplated. For example, as shown in FIGS. 8 and 9, tear line 898 and 899 jut upward in the direction of tear line 850 just before the intersection with the side panels to create triangular remainders or lips 809 and 839, respectively, with the rest of the tear lines 898 and 899 continuing along respective fold lines 906 and 936. These remainders 809 and 839 provide additional structural support that reinforce, for instance, the top panel flap, which will be stronger for folding during carton production. Remainders 809 and 839, though not necessarily feasible for rectangular products to be dispensed from the carton that would engage the remainders 809 and 839 during product removal, could be used as a restriction to keep cylindrical objects from rolling out of the carton before dispensing. The remainders 809 and 839 could also provide desired additional structural support for dispensing of bags, pouches, or other non-rectangular base products.

In order to form the blank 10 into a carton, the blank is folded and glued to result in a carton with two closed ends. First, the adhesive panels 36, 44, 76, 84 are coated with an adhesive, such as glue, tape, or other adhesive. Divider panels 32, 40, 72, 80 are folded to form a center divider to support the bottom flaps 12, 28, 52, 68 and top panels 20 and 60. In the embodiment of FIG. 1, bottom flaps 12 and 52 are slightly wider than bottom flaps 28 and 68 to allow a slight overlap capable of receiving glue or another adhesive when the blank 10 is formed into a carton. Although the overlap can vary as desired, the overlap of bottom flaps 12 and 52 shown for example in FIG. 1 is approximately one inch. This overlap should generally not be less than one-half inch to allow for application of adhesive during manufacturing sufficient to hold the carton together. The adhesive panels 36 and 76 are adhered to the top panels 20 and 60 to create a center divider with divider panels 32, 40, 72, 80. Once the blank 10 is formed into a carton sleeve by the adhesion of the bottom flaps 12 and 52 to the adhesive panels 44 and 84, the product is then loaded into the carton and the various end flaps on both ends are closed. On the upper end, first side end flaps 134 and 140 are folded sideways, then bottom end flaps 130 and 144 are folded downwardly, and top end flap 138 is folded upwardly. At the lower end, side end flaps 104 and 110 are folded sideways, then, bottom end flaps 100 and 114 are folded downwardly, and top end flap 108 is folded upwardly. These various end flaps are held together by glue and/or other adhesive means. The blank 10 shown in FIG. 1 is not dimensionally restricted to the scale provided and is shown for example purposes only. Thus, wider panels can be provided to accommodate larger products to be stored, displayed, and dispensed and smaller dimensions can be provided to accommodate smaller products.

Figure 3:
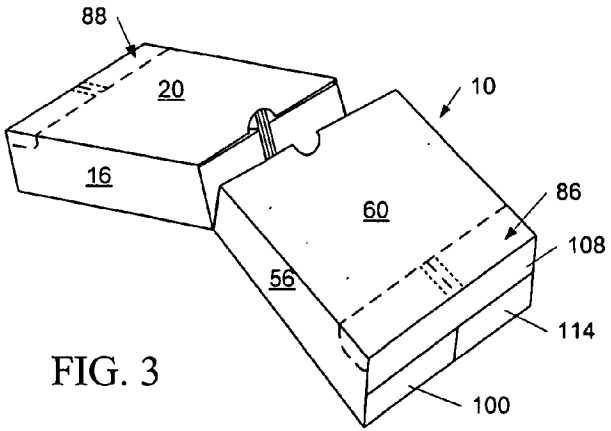
FIG. 3 is a perspective view of the carton being cracked in half at the tear line.
Figure 2:
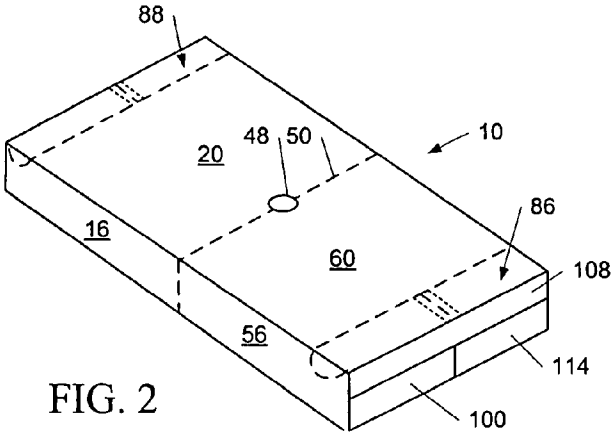
FIG. 2 is a perspective view of the carton loaded with product in a shipping configuration.
Figure 4:
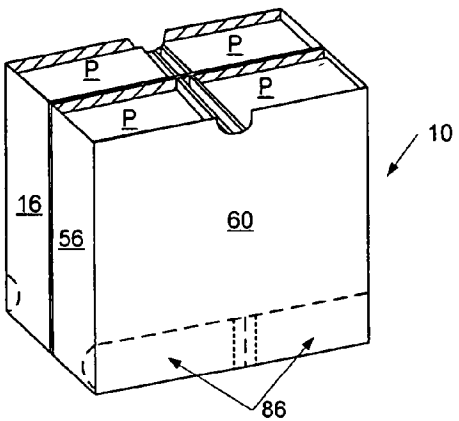
FIG. 4 is a perspective view of the carton in a display configuration.

As shown in FIG. 2, blank 10 is formed into a carton ready for shipping or storage with product encased therein. After the carton has been shipped or otherwise delivered to a retailer or other end user, FIG. 3 shows the carton being "cracked" in half using the finger hole 48 and tear line 50. As shown in FIG. 4, the carton is then set upright, e.g., on a retailer's shelf, on its sealed ends with the top panel 60 of the carton facing outward and with the top panel 20 facing inward.

Figure 5:
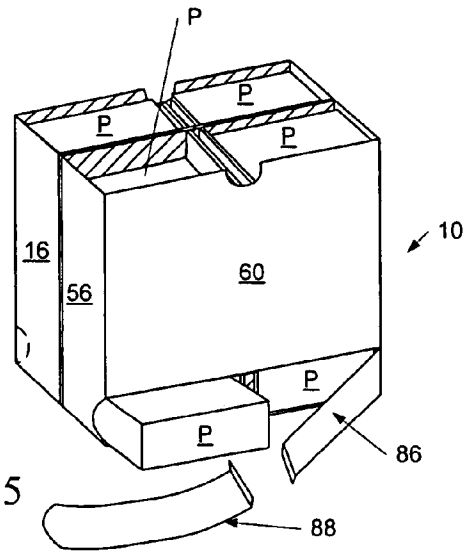
FIG. 5 is a perspective view of the carton in a dispensing configuration with the front lower dispenser being removed.

FIG. 5 shows the carton in a display position, with the dispenser 86 at the lower dispensing sections of the top panel 60 torn away to expose the product. Both sides of the dispenser 86 is removed in FIG. 5 along tear lines 90, 92, 94, 96, and 98 and discarded. The dispenser 86 creates an opening large enough for product to be removed from the carton. As shown in FIGS. 1-5, the dispenser 86 is provided with bisecting tear line 96 and perforation 87, which facilitate opening of the dispenser 86 by allowing access to the dispensers by a finger or other object to facilitate removal of the dispenser 86. The arcuate tear lines 92 and 94 wrap around the side panels 56 and 64 of the carton enough to allow a person's fingers more easily to grasp a product for dispensing.

As shown in FIGS. 3-7, a center divider, formed by divider panels 32, 40, 72, and 80 separates product in the carton for easier dispensing and provide additional structure for the carton. With multiple rows of product in the carton, the center divider creates a void to aid in the grasping of the product for removal during dispensing. However, the center divider need not necessarily create a void for grasping the product, especially if the carton is provided with a void in the side panels, such as the one created by tear lines 92 and 94, which could allow for a person's fingers to grasp the product without the void created by the divider panels. Further, a center divider need not be provided in the carton and the blank could be formed into a carton with adhesive on or adjacent bottom flaps 12, 28, 52, 68.

Since the dispensers 86 and 88 are located at the lower end of the cracked carton, all upper product will drop toward the bottom of the carton via gravity upon removal of a lower product. This gravity assisted feed will allow removal of product through dispenser 86 or 88 until all product has been completely removed from a half of the carton.

Once the product has been completely removed from the front half of the carton, the retailer can rotate the carton 180 degrees to place the back half into a dispensing position and can decide whether to remove the front half from the back half. The front half of the carton can remain attached at the hinged part of the tear line 50 that proceeds through bottom flaps 12, 28, 52, and 68 and can be used as a void-filler on the shelf to maintain a consistent and pleasant looking display. Alternatively, as shown in FIG. 6, once the product has been completely removed from the front half of the carton, the empty half can be torn away at the hinged part of the tear line 50 and can be discarded. Whether the front half of the carton is removed from the back half of the carton or remains attached to the back half of the carton, top panel 20 is rotated to face outward on the shelf. Analogous to dispenser 86, dispenser 88 is removed via tear lines 91, 93, 95, 97, 99 to create an opening in the lower end of top panel 20. The opening created by dispenser 88 is large enough for product to be removed from this back half of the carton. A center divider can be provided to create a void to aid in grasping the product for removal. Since the opening created by dispenser 88 is located at the lower end of the back half, all product is gravity fed toward the bottom of the carton during product dispensing until the back half is emptied. Once all of the product has been removed, the back half of the carton, or the entire carton if the front half was not separated therefrom, can be removed from the shelf and discarded. A new carton can then replace the emptied carton.

As shown in FIG. 7, the back half of the carton has a dispenser at its lower end, which can be removed for product dispensing. The dispenser on the back half generally is removed in the same manner as the dispenser from the front half as shown in FIG. 5. The emptied, front half of the carton, now removed from the back half of the carton, can be discarded.

Figure 10:
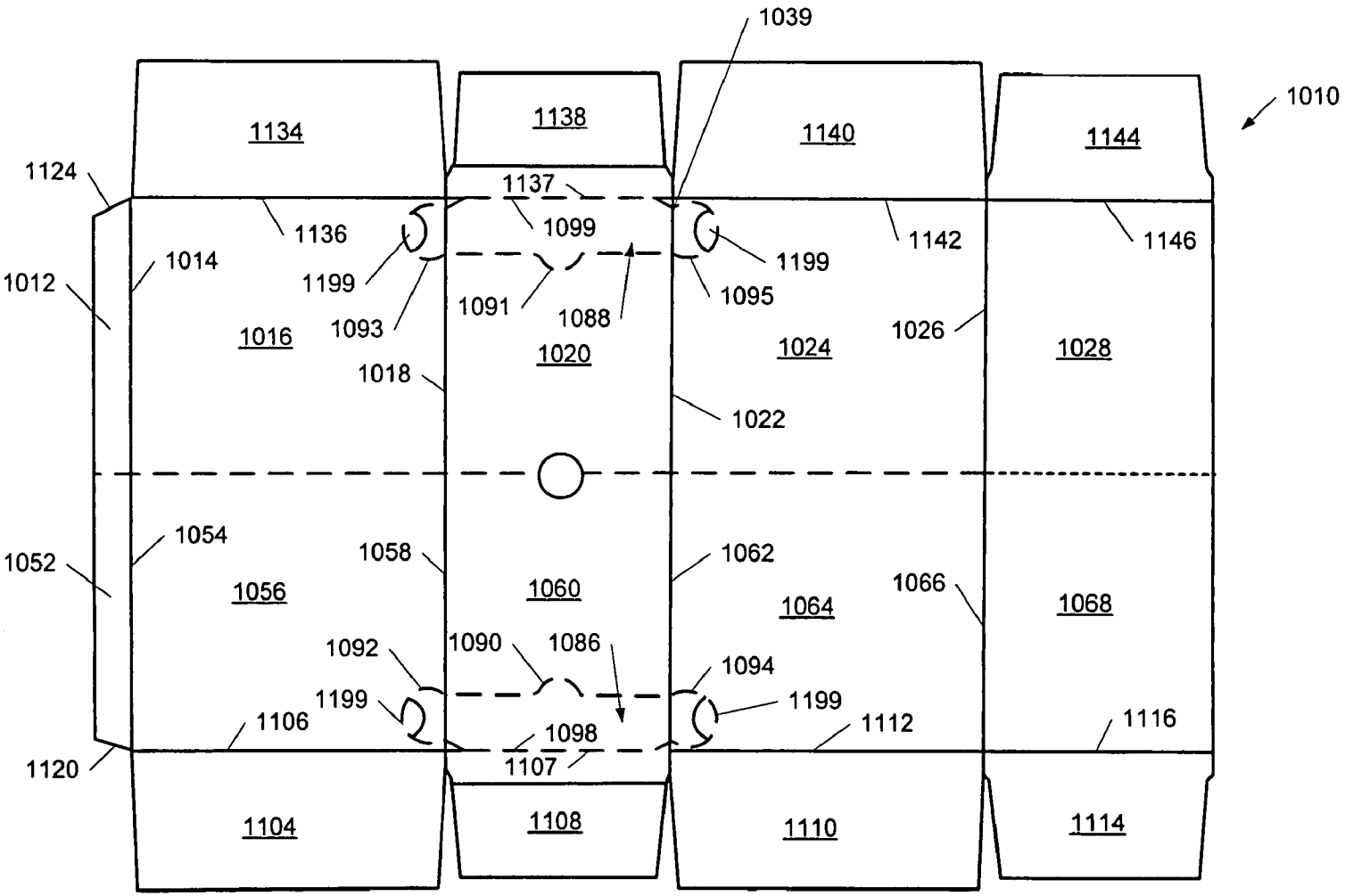
FIG. 10 shows another embodiment of a single column blank from which a dispenser can be formed.

An alternative embodiment of the present invention is shown in FIGS. 8 and 10. At the lower end, the blank 810 has a bottom flap 812, which is connected by fold line 814 to side panel 816, which is in turn connected by fold line 818 to top panel 820. Top panel 820 is connected by fold line 822 to side panel 824, which in turn is connected by fold line 826 to bottom flap 828. This embodiment does not include a divider panel section since product is dispensed in single columns in side-by-side carton halves.

A finger hole 848 is included between top panels 820 and 860 and disposed along tear line 850. As detailed in FIG. 1 in reference to finger hole 48, finger hole 848 will enable receipt of a person's finger or other object to separate the carton halves along tear line 850 to convert the carton from a shipping/storage configuration to a display/dispensing configuration. Although the finger hole 848 is shown circular, it can be any other configuration that permits disengagement of tear line 850. The finger hole 848 also could be covered with a flap (not shown) that could be detached or punctured to provide access to the finger hole 848 to disengage tear line 850.

At the lower end of the blank 810, a bottom flap 852 is connected by fold line 854 to side panel 856, which in turn is connected by fold line 858 to top panel 860. Top panel 860 is connected by fold line 862 to side panel 864, which in turn is connected by fold line 866 to bottom flap 868. Bottom flaps 828 and 868 are configured to receive an adhesive to secure the blank 810 into a carton configuration. Generally, the bottom flaps 828 and 868 receive an adhesive and either overlap over, or adhere beneath, bottom flaps 812 and 852.

The bottom flaps 828 and 868 have adhesive panel ends 924 and 920, respectively, which are angled slightly inward, to facilitate folding once the carton is formed. Adhesive panels ends 920 and 924 allow for any slight misalignment during manufacture of the carton from blank 810 to keep the end flap from the score line.

At the lower end of the carton blank 810, bottom end flap 900 is connected to bottom flap 852 by a fold line 902. Side end flap 904 is connected to side panel 856 via tear line 898 and/or fold line 906. Top end flap 908 is connected to top panel 860 by fold line 907. Side end flap 910 is connected to side panel 864 by a fold line 912.

At the upper end, bottom end flap 930 is connected to bottom flap 812 by fold line 932. Side end flap 934 is connected to side panel 816 by fold line 936 and/or at tear line 899. Top end flap 938 is connected to top panel 820 at fold line 937. Side end flap 940 is connected to side panel 824 at fold line 942.

The tear line 850 is shown with cuts, nicks, tears, creases, or different combinations thereof, along the blank 810. The particular orientations and combinations shown are preferred in this embodiment, but should not be limiting in any manner. As shown in FIG. 8, tear line 850 includes a combination of cuts and nicks that will facilitate separation of the halves of the carton using finger hole 848. Through the bottom flaps, the tear line 850 comprises a combination of cuts and creases that create a type of "hinge," which will generally not allow as easy a separation of bottom flaps from one another as the tear line 850 through the top and side panels. In contrast to blank 10 of FIG. 1, the finger hole 848 is shown in FIG. 8 is in the top panels 820 and 860 and the dispensers are primarily in the side panels 816 and 856 and overlap into the top panels 820 and 860 and bottom flaps 812 and 852. Thus, after the carton has been formed, the carton can be cracked along tear line 850 through the top panel and side panels using finger hole 848 and then hinged along the bottom flaps 812, 828, 852, and 868.

Dispensers 886 and 888 are formed in side panels 816 and 856, top panels 820 and 860, and bottom flaps 812 and 852 at the end portions of each panel adjacent the end flaps and opposite the tear line 850. In forming dispensers 886 and 888, tear lines 890 and 891 are spaced from their respective end flaps a distance that will allow product to be removed from the carton once formed. The tear lines 890 and 891 can include any orientation desired, but are shown in FIG. 8 with a convexity in the middle portion that will enable product to be engaged by a user's finger or other object to facilitate removal of the product from the carton during dispensing. Tear lines 892 and 893 are formed in bottom flaps 852 and 812, respectively, and tear lines 894 and 895 are formed in top panels 860 and 820, respectively. Tear lines 892, 893, 894, and 895 are shown arcuate, but could be any other configuration, such as angled or rectangular, that allows removal of the dispensers 886 and 888. Tear lines 898 and 899 are formed along part of the intersecting fold lines between the end flaps and the side panels 816 and 856. Dispensers 886 and 888 typically are removed by insertion of a finger or other object into the carton at, or adjacent, tear lines 892, 893, 894, or 895. These tear lines 892, 893, 894, or 895 either can be pushed into, or pulled outward from, the carton to remove dispensers 886 and 888. Either dispenser 886 or 888 can be removed individually as desired for dispensing, but the dispensers 886 and 888 generally both will be removed to provide dispensing openings to remove product from either half of the side-by-side carton.

In order to form the blank 810 into a carton, the blank is folded and glued to result in a carton with two closed ends. Here, panels 828 and 868 are coated with an adhesive, such as glue or the like, or provided with tape or other adhesive. The panels 828 and 868 are adhered to bottom flaps 812 and 852. Once the blank 810 is formed into a carton sleeve, product is then loaded into the carton and the various end flaps on both ends are closed. On the upper end, first side end flaps 934 and 940 are folded sideways, then bottom end flap 930 is folded downwardly, and top end flap 938 is folded upwardly. At the lower end, side end flaps 904 and 910 are folded sideways, then, bottom end flap 900 is folded downwardly, and top end flap 908 is folded upwardly. These various end flaps are held together by glue and/or other adhesive means. The blank 810 shown in FIG. 1 is not dimensionally restricted to the scale provided and is shown for example purposes only. Thus, wider panels can be provided to accommodate larger products to be stored, displayed, and dispensed, or, smaller dimensions can be provided to accommodate smaller products.

FIGS. 9A-9D show the side-by-side blank of FIG. 8 formed into a carton, cracked open, set upright, and dispensing product. Dispensers 886 and 888 are shown removed in FIG. 9D to dispense from both sides of the carton.

Another alternative embodiment of a blank 1010 is shown in FIG. 10. At the lower end, the blank 1010 has a bottom flap 1012, which is connected by fold line 1014 to side panel 1016, which is in turn connected by fold line 1018 to top panel 1020. Top panel 1020 is connected by fold line 1022 to side panel 1024, which in turn is connected by fold line 1026 to bottom flap 1028. This embodiment does not included a divider panel section since product is dispensed in single column form.

A finger hole 1048 is included between top panels 1020 and 1060 and disposed along tear line 1050. As detailed in FIG. 1 in reference to finger hole 48, finger hole 1048 enables receipt of a person's finger or other object to separate the carton halves at tear line 1050 to convert the carton from a shipping/storage configuration to a display and/or dispensing configuration. Although finger hole 1048 is shown circular, it can be any other configuration that permits disengagement of tear line 1050. The finger hole 1048 also could be covered with a flap (not shown) that could be detached or punctured to provide access to the finger hole 1048 to disengage tear line 1050.

At the lower end of the blank 1010, a bottom flap 1052 is connected by fold line 1054 to side panel 1056, which in turn is connected by fold line 1058 to top panel 1060. Top panel 1060 is connected by fold line 1062 to side panel 1064, which in turn is connected by fold line 1066 to bottom flap 1068. Bottom flaps 1012 and 1052 are configured to receive an adhesive to secure the blank 1010 in place during carton formation. Generally, the bottom flaps 1012 and 1052 will receive an adhesive and overlap bottom flaps 1028 and 1068.

At the lower end of the carton blank 1010, side end flap 1104 is connected to side flap 1056 by a fold line 1106. Top end flap 1108 is connected to top panel 1060 by tear line 1098 and/or fold line 1107. Side end flap 1110 is connected to side panel 1064 by fold line 1112. Bottom end flap 1114 is connected to bottom flap 1068 by a fold line 1116.

At the upper end, side end flap 1134 is connected to side panel 1016 by fold line 1136. Top end flap 1138 is connected to top panel 1020 by fold line 1137 and/or at tear line 1099. Side end flap 1140 is connected to side panel 1024 at fold line 1142. Bottom end flap 1144 is connected to bottom flap 1028 at fold line 1146.

The tear line 1050 is shown with cuts, nicks, tears, creases, and different combinations of these along the blank 1010. The particular orientations and combinations shown are preferred in this embodiment and should not be limiting in any manner. As shown in FIG. 10, tear line 1050 includes a combination of cuts and nicks that will facilitate separation of the halves of the carton using finger hole 1048. Then, through the bottom flaps, the tear line 1050 comprises a combination of cuts and creases that create a type of "hinge," which generally will not be as easy to separate from one another as the tear line 1050 that proceeds through the top and side panels. The finger hole 1048 is shown in the top panels 1020 and 1060 with the dispensers 1086 and 1088 shown mostly in the top panels 1020 and 1060 and overlap into the side panels 1016, 1024, 1056, and 1060. After the carton has been formed, the carton can be cracked along tear line 1050 through the top panel and side panels using finger hole 1048. The carton then can be hinged along the bottom flaps 1012, 1028, 1052, and 1068.

Dispensers 1086 and 1088 are formed in top panels 1020 and 1060 and side panels 1016, 1024, 1056, and 1064 at the end portions of each panel adjacent the end flaps and opposite the tear line 1050. In forming dispensers 1086 and 1088, tear lines 1090 and 1091 are spaced from their respective end flaps a distance that will allow product to be removed from the carton. The tear lines 1090 and 1091 can include any orientation as desired and are shown in FIG. 10 with a convexity in the middle portion that enables product engagement by a user's finger or other object for removal from the carton during dispensing. Tear lines 1092, 1093, 1094, and 1095 are formed in their respective side panels 1056, 1016, 1064, and 1024, and are shown arcuate, but could be any other configuration, such as angled or rectangular, that will allow the dispensers 1086 and 1088 to be removed from the carton. Tear lines 1098 and 1099 are formed along part of the intersecting fold lines between the end flaps and the top panels 1020 and 1060. Dispensers 1086 and 1088 are typically removed by insertion of a finger or other object into the carton into 1092, 1093, 1094, or 1095. These tear lines 1092, 1093, 1094, or 1095 can either be pushed into, or pulled outward from, the carton to facilitate removal of dispensers 1086 and 1088. Either dispenser 1086 or 1088 can be removed individually as desired for dispensing, with the dispensers 1086 and 1088 generally removed to provide an opening to remove product from the front facing half of the carton. Additionally, as shown in FIG. 10, the tear lines 1092, 1093, 1094, or 1095 can include holes 1199 punched therethrough that are not enclosed by the carton when formed. These holes 1199 can receive a finger or other object to facilitate removal of the dispensers 1086 and 1088.

Analogous to the tear lines shown in FIGS. 8 and 9, the carton blank of FIG. 10 can be formed with any part of, or the entirety of, the dispenser tear lines spaced from the end flap fold lines. In FIG. 10, tear lines 1098 and 1099 jut upward in the direction of tear line 1050 just before the intersection with the side panels to create triangular remainders or lips 1009 and 1039, respectively, with the rest of the tear lines 1098 and 1099 continuing along respective fold lines 1107 and 1137. These remainders 1009 and 1039 provide additional structural support that reinforce, for instance, the side panel flap, which will be stronger for folding during carton production. Remainders 1009 and 1039, though not necessarily feasible for rectangular products to be dispensed from the carton that would engage the remainders 1009 and 1039 during product removal, could be used as a restriction to keep cylindrical objects from rolling out of the carton before dispensing. The remainders 1009 and 1039 could also provide desired additional structural support for dispensing of bags, pouches, or other non-rectangular base products.

While the invention has been disclosed in its preferred forms, it will be apparent to those skilled in the art that many modifications, additions, and deletions can be made therein without departing from the spirit and scope of the invention and its equivalents as set forth in the following claims.

We claim:

1. A carton having two closed ends housing a plurality of containers in two rows, the carton comprising:

a top panel, two bottom panels, and two foldably attached adjoining side panels;

each end of the carton having a top end flap foldably attached to the top panel, bottom end flaps foldably attached to each said bottom panel, and side end flaps foldably attached to each said side panel;

means for attaching said top end flap, said bottom end flaps, and said side end flaps together to close each said end of the carton; and, a tear line extending through the top panel, the side panels, and the bottom panels approximately halfway between each said end of the carton, wherein when the tear line is torn through the top panel and the side panels, the carton is foldable along the tear line extending through the bottom panels to form two halves of the enclosed carton;

a center divider to separate the two rows in the enclosed carton.

2. The carton of claim 1, wherein a finger hole is provided in the top panel to facilitate opening of the tear line.

3. The carton of claim 1, wherein the center divider comprises two divider panels to reinforce the carton.

4. The carton of claim 3, wherein the two panels are foldable about fold lines.

5. The carton of claim 3, wherein the center divider includes at least one adhesive panel capable of receiving an adhesive.

6. The carton of claim 1, wherein the bottom panels are separable along the tear line to separate the two halves of the carton.

7. The carton of claim 1, wherein the tear line comprises cuts, nicks, creases, or any combination of cuts, nicks, or creases.

8. A carton having two closed ends housing a plurality of containers in two rows, the carton comprising:

a top panel, two bottom panels, and two foldably attached adjoining side panels;

each end of the carton having a top end flap foldably attached to the top panel, bottom end flaps foldably attached to each said bottom panel, and side end flaps foldably attached to each said side panel;

means for attaching said top end flap, said bottom end flaps, and said side end flaps together to close each said end of the carton;

a tear line extending through the top panel, the side panels, and the bottom panels approximately halfway between each said end of the carton, wherein when the tear line is torn through the top panel and the side panels, the carton is foldable along the tear line extending through the bottom panels to form two halves of the enclosed carton; and, a dispenser formed in the top panel at each end of the carton.

9. The carton of claim 8, wherein each said dispenser comprises at least one removable panel.

10. The carton of claim 9, wherein each said dispenser is removable from the carton by dispenser tear lines.

11. The carton of claim 10, wherein the dispenser tear lines extend through the top panel and through each said side panel.

12. The carton of claim 11, wherein the dispenser tear lines that extend through the top panel includes an upper and a lower dispenser tear line, which are spaced apart a minimum distance to permit removal of each said container.

13. The carton of claim 12, wherein the lower dispenser tear line substantially coincides with the fold line at the top end flap.

14. The carton of claim 13, wherein a portion of the lower dispenser tear line extends upward at each end of the top panel to create a remainder that reinforces the carton.

15. The carton of claim 14, wherein the remainder does not interfere with removal of the containers from the dispensers.

16. The carton of claim 12, wherein the lower dispenser tear line is spaced from the fold line at the top end flap.

17. The carton of claim 8, wherein each said dispenser includes dispenser halves that are individually removable from the enclosed carton.

18. The carton of claim 12, wherein the dispenser halves include perforations adjacent a center of the top panel that allow a flap of each said dispenser half to be pushed into the carton to facilitate removal of each said dispenser half.

19. The carton of claim 17, further including a center divider to separate the two rows in the enclosed carton.

20. The carton of claim 19, wherein the flap is receivable in a space created by the center divider.

21. The carton of claim 1, wherein the carton is foldable at the bottom panels to create front and back halves with the bottom panels adjacent.

22. An enclosed carton having two closed ends housing a plurality of containers, the carton comprising:

a top panel, two bottom panels, and two foldably attached adjoining side panels;

each end of the carton having a top end flap foldably attached to the top panel, bottom end flaps foldably attached one of said bottom panels, and side end flaps foldably attached to each said side panel;

means for attaching said top end flap, said bottom end flaps, and said side end flaps together to close each said end of the carton; and, a tear line extending through the top panel, the side panels, and the bottom panels approximately halfway between each said end of the carton, wherein when the tear line is torn through the top panel and the side panels, the carton is foldable along the tear line extending through the bottom panels to form two halves of the enclosed carton;

a dispenser formed at each end of the carton in one of the side panels.

23. The carton of claim 22, wherein the carton is foldable at the bottom panels to create side-by-side halves with the bottom panels adjacent.

24. The carton of claim 22, wherein a finger hole is provided in the top panel to facilitate opening of the tear line.

25. The carton of claim 22, wherein the bottom panels are separable along the tear line to separate the two halves of the carton.

26. The carton of claim 22, wherein the tear line comprises cuts, nicks, creases, or any combination of cuts, nicks, or creases.

27. The carton of claim 22, wherein each said dispenser comprises at least one removable panel.

28. The carton of claim 27, wherein each said dispenser is removable from the carton by dispenser tear lines.

29. The carton of claim 28, wherein the dispenser tear lines extend through the one of the said side panels, the top panel, and through the bottom panel.

30. The carton of claim 29, wherein the dispenser tear lines that extend through the side panel include an upper and a lower dispenser tear line, which are spaced apart a minimum distance to permit removal of each said container.

31. The carton of claim 30, wherein the lower dispenser tear line substantially coincides with the fold line at the top end flap.

32. The carton of claim 31, wherein a portion of the lower dispenser tear line extends upward at each end of the top panel to create a remainder that reinforces the carton.

33. The carton of claim 32, wherein the remainder does not interfere with removal of the containers from the dispensers.

34. The carton of claim 30, wherein the lower dispenser tear line is spaced from the fold line at the top end flap.

35. The carton of claim 29, wherein the dispenser tear lines in the top panel and in the bottom panel can be pushed into the carton to facilitate removal of each said dispenser.

36. The carton of claim 29, wherein dispenser tear lines in the top panel and in the bottom panel include a cutout to facilitate removal of the dispenser.

37. A carton having two closed ends housing a plurality of containers, the carton comprising:

a top panel, a bottom panel, and two foldably attached adjoining side panels;

each end of the carton having a top end flap foldably attached to the top panel and bottom end flaps foldably attached to the bottom panel;

means for attaching said top end flap and said bottom end flap together to close each said end of the carton; and, a tear line extending through the top panel, the side panels, and the bottom panel approximately halfway between each said end of the carton, wherein when the tear line is torn through the top panel and the side panels, the carton is foldable along the tear line extending through the bottom panel to form two halves of the enclosed carton;

wherein the carton includes an adhesive panel on one of the two side panels that is received by the bottom panel to close the carton.

38. The carton of claim 37, wherein each end of the carton has side end flaps foldably attached to each side panel.

39. The carton of claim 38, wherein the side end flaps are closed together with the top end flap and bottom end flap to close each end of the carton.

* * * * *